US009508306B2

(12) United States Patent
Kim et al.

(10) Patent No.: US 9,508,306 B2
(45) Date of Patent: Nov. 29, 2016

(54) DISPLAY DEVICE HAVING MULTIPLE DATA DRIVER ICS SHARING GAMMA VOLTAGES

(71) Applicant: LG DISPLAY CO., LTD., Seoul (KR)

(72) Inventors: Hyo Jin Kim, Yongin-si (KR); Ji Woong Park, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 10 days.

(21) Appl. No.: 14/586,035

(22) Filed: Dec. 30, 2014

(65) Prior Publication Data

US 2015/0187321 A1 Jul. 2, 2015

(30) Foreign Application Priority Data

Dec. 31, 2013 (KR) ..... 10-2013-0168215

(51) Int. Cl.

*G09G 3/36* (2006.01)
*G09G 3/32* (2016.01)
*G09G 3/20* (2006.01)

(52) U.S. Cl.

CPC ..... *G09G 3/3696* (2013.01); *G09G 3/20* (2013.01); *G09G 3/3275* (2013.01); *G09G 3/3644* (2013.01); *G09G 3/3666* (2013.01); *G09G 3/3685* (2013.01); *G09G 2300/0426* (2013.01); *G09G 2310/027* (2013.01); *G09G 2310/0218* (2013.01); *G09G 2310/0275* (2013.01); *G09G 2310/0281* (2013.01); *G09G 2320/028* (2013.01)

(58) Field of Classification Search

CPC .... G09G 3/20; G09G 3/2003; G09G 3/3275; G09G 3/3291; G09G 3/3644; G09G 3/3666; G09G 3/3685; G09G 3/3696; G09G 2300/0426; G09G 2310/0218; G09G 2310/027; G09G 2310/0275; G09G 2310/0281; G09G 2310/0289; G09G 2320/0233; G09G 2320/0242; G09G 2320/0276; G09G 2320/028; G09G 2320/0673

See application file for complete search history.

(56) References Cited

U.S. PATENT DOCUMENTS

2006/0256065 A1* 11/2006 Jung ..... G09G 3/3685 345/100
2007/0046599 A1* 3/2007 Kim ..... G09G 3/3696 345/89
2007/0247408 A1 10/2007 Nishimura et al.
2007/0247409 A1* 10/2007 Nishimura ..... G09G 3/3688 345/89
2010/0013869 A1* 1/2010 Matsumoto ..... G09G 3/2011 345/690
2014/0085349 A1* 3/2014 Shiibayashi ..... G09G 5/10 345/690

FOREIGN PATENT DOCUMENTS

JP 2002236473 * 8/2002
JP 2005070338 * 3/2005
JP 2005345808 * 12/2005
KR 1020110076015 A 7/2011

* cited by examiner

*Primary Examiner* — Keith Crawley
(74) *Attorney, Agent, or Firm* — Dentons US LLP

(57) ABSTRACT

Disclosed is a display device comprising a panel in which a pixel is formed in each of a plurality of intersection areas between a plurality of data lines and a plurality of gate lines. Two or more data driver integrated circuits (ICs) supply data voltages to the plurality of data lines and a gate driver outputs a scan signal to the plurality of gate lines. A timing controller drives the data driver ICs and the gate driver. A plurality of gamma voltage generators generate gamma voltages respectively provided in the data driver ICs such that each of the data driver ICs generates data voltages using gamma voltages generated by another data driver IC of the two or more data driver ICs.

6 Claims, 4 Drawing Sheets

DISPLAY DEVICE HAVING MULTIPLE DATA DRIVER ICS SHARING GAMMA VOLTAGES

CROSS-REFERENCE TO RELATED APPLICATION

This application claims the benefit of the Korean Patent Application No. 10-2013-0168215 filed on Dec. 31, 2013, which is hereby incorporated by reference for all purposes as if fully set forth herein.

BACKGROUND

1. Field of the Disclosure

The present invention relates to a display device, and more particularly, to a display device, in which a gamma voltage generator is equipped in a data driver integrated circuit (IC), and a method of driving the same.

2. Background of the Related Art

A flat panel display (FPD) device is applied to various electronic devices such as portable phones, tablet personal computers (PCs), notebook computers, monitors, etc. Examples of the FPD device include liquid crystal display (LCD) devices, plasma display panel (PDP) devices, organic light emitting display devices, etc. Recently, electrophoretic display (EPD) devices are being widely used as one type of the FPD device.

In such FPD devices, LCD devices are devices that display an image using the optical anisotropy of liquid crystal. The LCD devices have a thin thickness, a small size, and low power consumption, and realize a high-quality image.

Among the display devices, organic light emitting display devices are self-emitting devices that self-emit light, and thus have a fast response time, high emission efficiency, high luminance, and a broad viewing angle.

An organic light emitting diode (OLED) configuring the organic light emitting display device includes an anode formed of indium tin oxide (ITO), a hole injection layer stacked on the anode, a hole transport layer stacked on the hole injection layer, an emission material layer stacked on the hole transport layer, an electron transport layer stacked on the emission material layer, an electron injection layer stacked on the electron transport layer, and a cathode stacked on the electron injection layer. Here, each of the hole transport layer, the emission material layer, and the electron transport layer is an organic thin film formed of an organic compound.

When a voltage is applied between the anode and the cathode, a positive hole injected from the anode moves to the emission material layer via the hole transport layer, and an electron injected from the cathode moves to the emission material layer via the electron transport layer. Carriers, such as the positive hole and the electron, are recombined in the emission material layer to generate an exciton. The exciton is shifted from an excited state to a ground state to emit light.

FIG. 1 is an exemplary diagram schematically illustrating a configuration of a related art display device. FIG. 2 is an exemplary diagram schematically illustrating configurations of two data driver ICs configuring the display device of FIG. 1.

The related art display device, as illustrated in FIG. 1, includes a panel 10 in which a plurality of pixels are respectively formed in a plurality of intersection areas between a plurality of data lines and a plurality of gate lines, a data driver IC (D-IC) that respectively supplies data voltages to the data lines, a gate driver (not shown) that supplies a scan signal to the gate lines, and a timing controller (not shown) that drives the data driver IC (D-IC) and the gate driver (not shown).

The data driver IC (D-IC) converts digital image data, transferred from the timing controller, into data voltages, and respectively supplies the data voltages for one horizontal line to the data lines at every one horizontal period in which the scan signal (a gate-on signal) is supplied to a corresponding gate line.

The data driver IC (D-IC) converts the image data into the data voltages by using gamma voltages supplied from a gamma voltage generator, and respectively supplies the data voltages to the data lines.

Only one the data driver IC may be equipped in the display device, but when a width of the panel 10 is long, as illustrated in FIG. 1, two the data driver ICs D-IC#1 and D-IC#2 may be equipped in the panel 10.

For example, when 5760 (=1920×3) pixels are formed on one horizontal line of the panel 10, each of the two data driver ICs respectively supplies data voltages to 2880 data lines.

Each of the two data driver ICs D-IC#1 and D-IC#2, as illustrated in FIG. 2, includes a shift register 31, a latch 32, a digital-to-analog converter (DAC) 33, a gamma voltage generator 35, and an output buffer 34.

When the gamma voltage generator 35 transfers generated gamma voltages to the DAC 33, the DAC 33 selects gamma voltages, respectively corresponding to 2880 pieces of image data transferred from the latch 32, from among the generated gamma voltages, and generates 2880 data voltages respectively corresponding to the 2880 pieces of image data. The generated 2880 data voltages are respectively supplied to the data lines through the output buffer 34.

In FIGS. 1 and 2, the two data driver ICs are used for respectively supplying the data voltages to the data lines formed in one the panel 10. However, three or more of the data driver ICs may be used depending on a size and resolution of the panel 10.

As described above, when two or more the data driver ICs are used for driving the data lines formed in one the panel 10, the same gamma voltage cannot be generated due to a deviation between the data driver ICs. A gamma voltage deviation between the data driver ICs affects a quality of an image output from the panel 10.

For example, as illustrated in FIGS. 1 and 2, when the two data driver ICs D-IC#1 and D-IC#2 are equipped in the panel 10 and each of the data driver ICs respectively outputs 2880 data voltages to 2880 data lines, 2880 channels CH are formed in the DAC 33 configuring each of the data driver ICs. Each of the channels CH generates one data voltage corresponding to one piece of digital image data.

In this case, the gamma voltage generator 35 generates eight gamma voltages RG1 to RG8 for pieces of image data corresponding to a red pixel, eight gamma voltages GG1 to GG8 for pieces of image data corresponding to a green pixel, and eight gamma voltages BG1 to BG8 for pieces of image data corresponding to a blue pixel, and supplies the generated gamma voltages to the DAC 33.

As described above, the gamma voltages are generated by the two data driver ICs, and there is a process differential between the two data driver ICs. Therefore, although pieces of image data having the same level are supplied to the two data driver ICs, a fine difference occurs between images respectively output by the two data driver ICs.

For example, as illustrated in FIG. 1, when a display area 11 of the panel 10 is divided into two areas A and B and the two areas A and B are respectively driven by the two data driver ICs, although pieces of image data having the same level are supplied to the two data driver ICs, a difference occurs between images respectively output by the two areas A and B.

To provide an additional description, since the gamma voltages are separately generated by the two data driver ICs, block dim occurs in the panel 10, and a uniformity of the panel 10 is reduced.

SUMMARY

Accordingly, the present invention is directed to provide a display device and a method of driving the same that substantially obviates one or more problems due to limitations and disadvantages of the related art.

An advantage of the present invention is to provide a display device and a method of driving the same.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the present invention, as embodied and broadly described, a display device is provided comprising: a panel in which a pixel is formed in each of a plurality of intersection areas between a plurality of data lines and a plurality of gate lines; two or more data driver integrated circuits (ICs) supplying data voltages to the plurality of data lines; a gate driver outputting a scan signal to the plurality of gate lines; and a timing controller driving the data driver ICs and the gate driver; a plurality of gamma voltage generators generating gamma voltages respectively provided in the data driver ICs, wherein each of the data driver ICs generates data voltages by using gamma voltages generated by the other data driver IC.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE ILLUSTRATED EMBODIMENTS

Reference will now be made in detail to the exemplary embodiments of the present invention, examples of which are illustrated in the accompanying drawings. Wherever possible, the same reference numbers will be used throughout the drawings to refer to the same or like parts.

Hereinafter, embodiments of the present invention will be described in detail with reference to the accompanying drawings.

Figure 1:
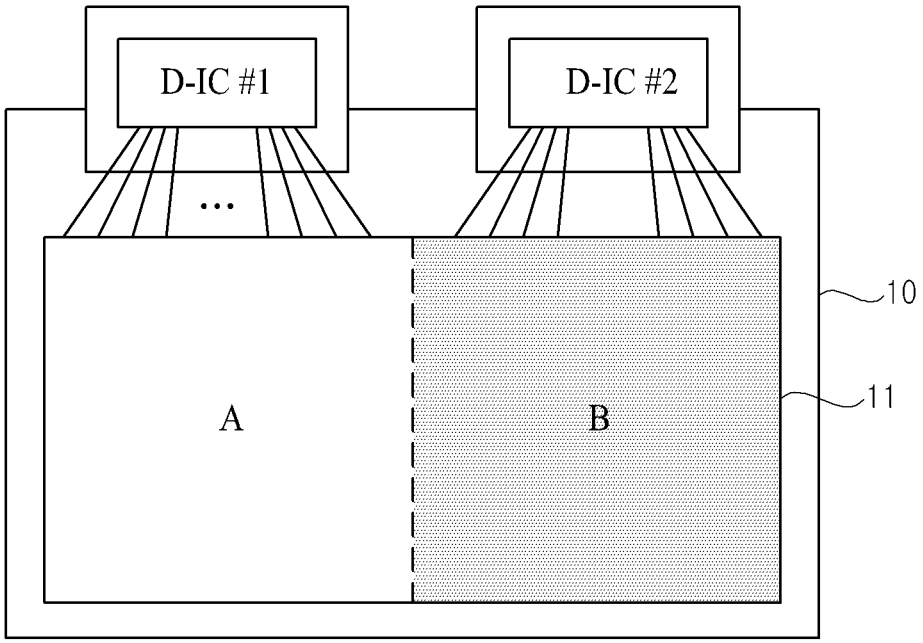
FIG. 1 Related Art
FIG. 1 is an exemplary diagram schematically illustrating a configuration of a related art display device.
Figure 2:
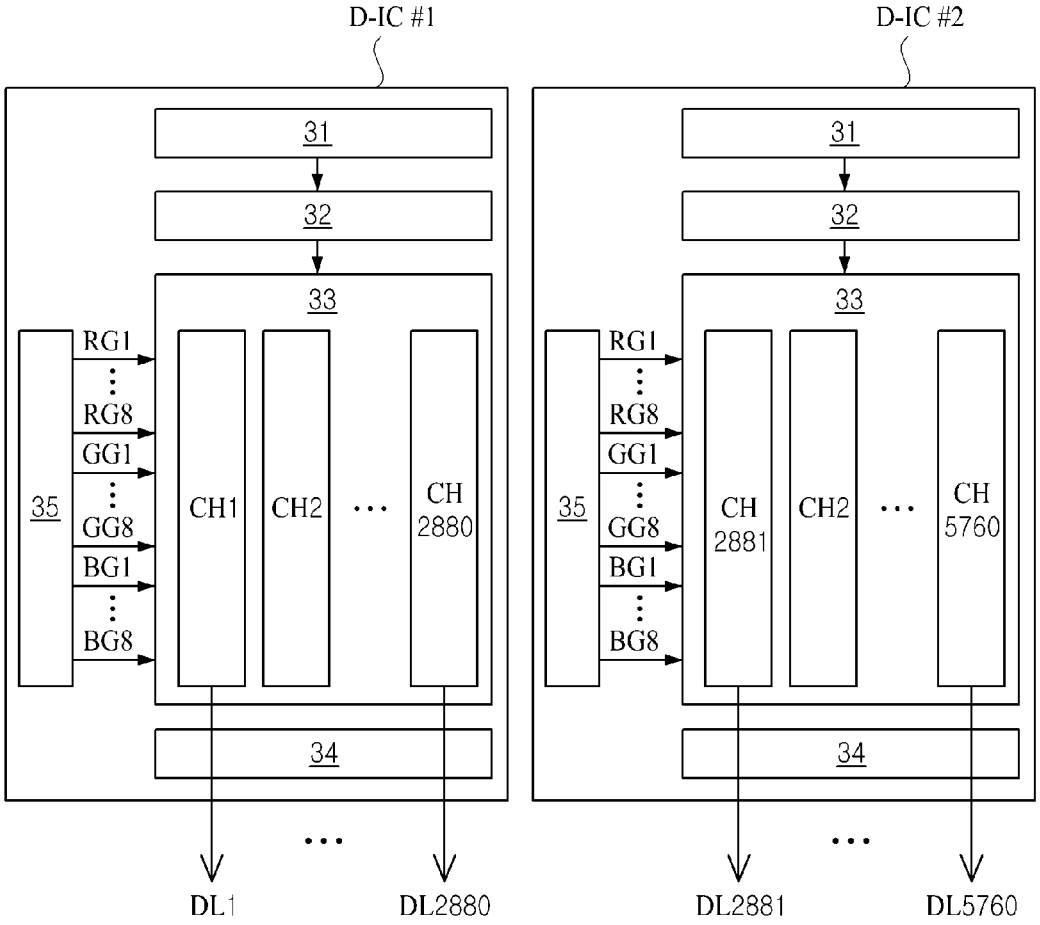
FIG. 2 Related Art
FIG. 2 is an exemplary diagram schematically illustrating configurations of two data driver ICs used in the display device of FIG. 1.
Figure 3:
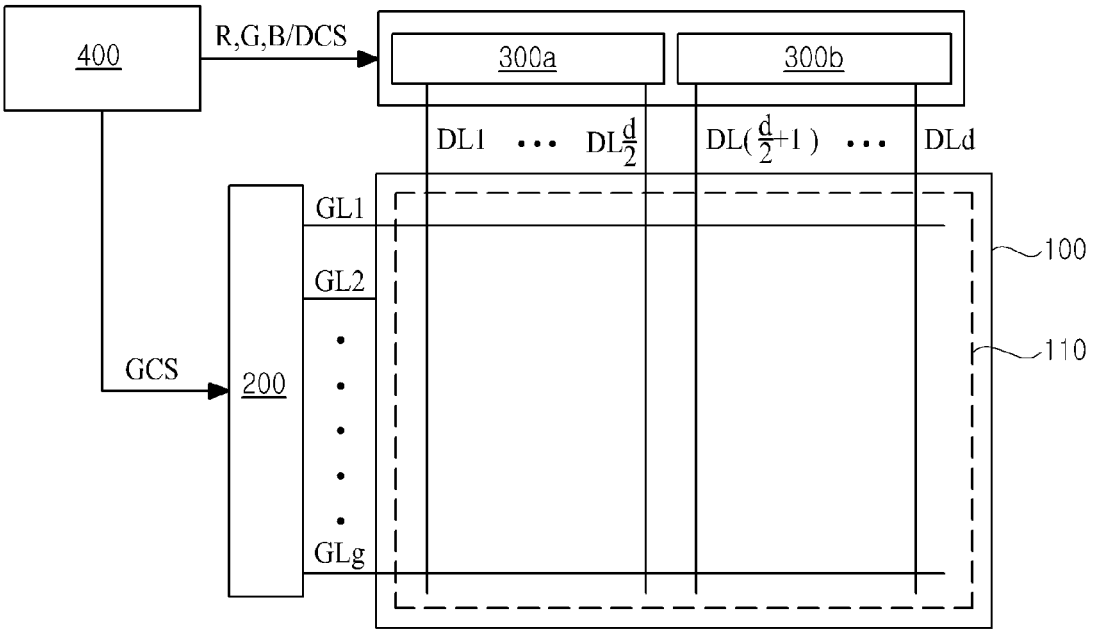
FIG. 3 is a block diagram illustrating a display device according to an embodiment of the present invention.
Figure 4:
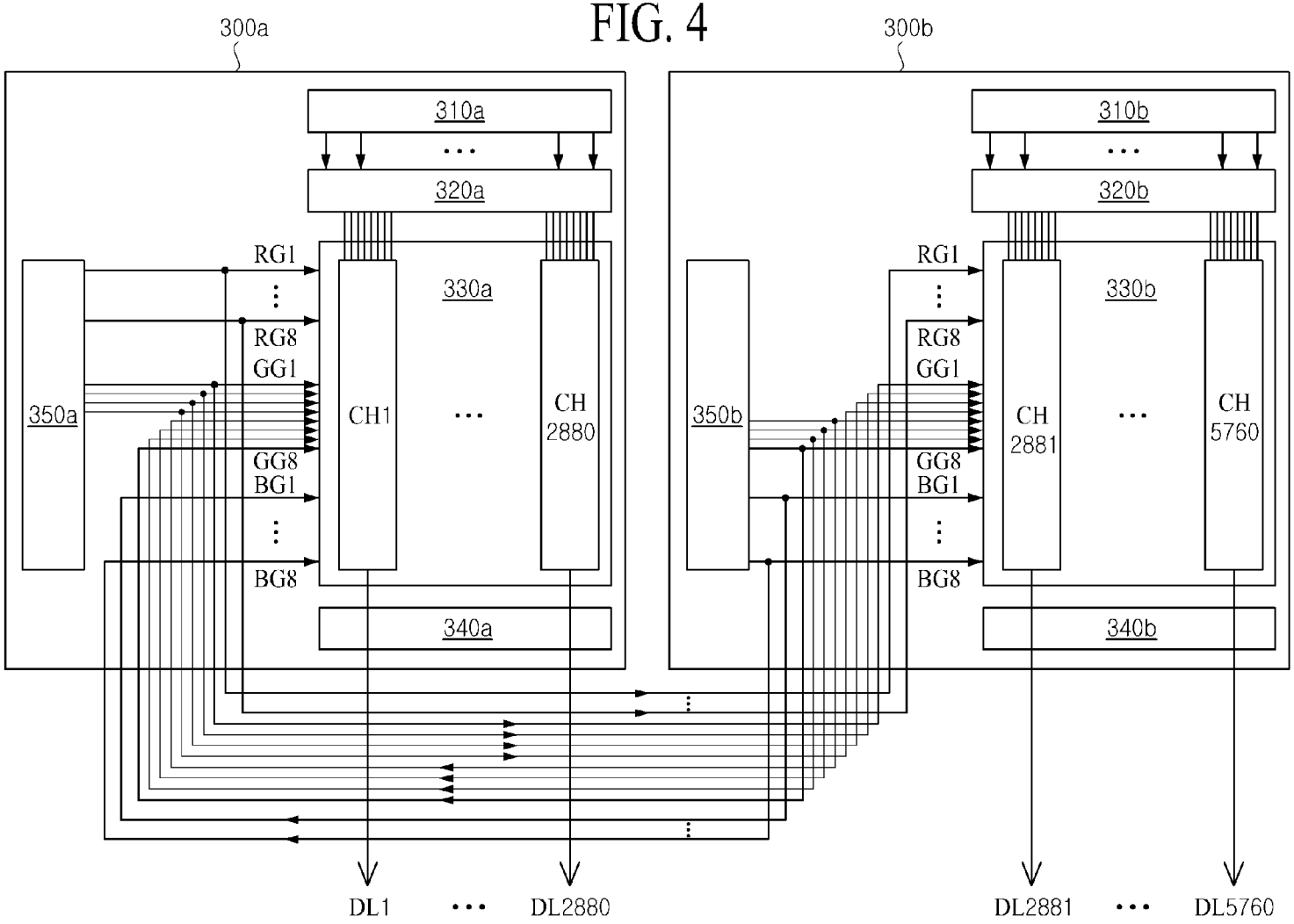
FIG. 4 is a block diagram illustrating a plurality of data driver ICs applied to the display device according to an embodiment of the present invention.

FIG. 3 is a block diagram illustrating a display device according to an embodiment of the present invention. FIG. 4 is a block diagram illustrating a plurality of data driver ICs applied to the display device according to an embodiment of the present invention.

The display device according to an embodiment of the present invention, as illustrated in FIG. 3, includes a panel 100 in which a pixel 110 is formed in each of a plurality of intersection areas between a plurality of data lines DL1 to DLd and a plurality of gate lines GL1 to GLg, two or more data driver ICs 300*a* and 300*b* that supply data voltages to the plurality of data lines DL1 to DLd, a gate driver 200 that outputs a scan signal to the plurality of gate lines GL1 to GLg, and a timing controller 400 that drives the data driver ICs 300*a* and 300*b* and the gate driver 200. Here, a plurality of gamma voltage generators 350*a* and 350*b* for generating gamma voltages are respectively provided in the data driver ICs 300*a* and 300*b*, and each of the data driver ICs 300*a* and 300*b* generates the data voltages by using gamma voltages generated by the other data driver IC.

The panel 100 outputs an image. In the panel 100, the pixel (P) 110 is formed in each of the intersection areas between the plurality of gate lines GL1 to GLg and the plurality of data lines DL1 to DLd.

The type of the panel 100 may vary depending on the kind of the display device. That is, when the display device is a LCD device, the panel 100 may be a liquid crystal panel, and when the display device is an organic light emitting display device, the panel 100 may be an organic light emitting panel. Hereinafter, for convenience of description, a case in which the display device is the organic light emitting display device and the panel 100 is the organic light emitting panel will be described as an example.

When the panel 100 is the organic light emitting panel, each of a plurality of the pixels 110 includes an organic light emitting diode (OLED) and a pixel circuit that drives the OLED.

The OLED includes a substrate, an anode formed on the substrate, an organic emission layer formed on the anode, and a cathode formed on the organic emission layer.

The anode outputs light with a current applied by a driving transistor which is formed in the pixel circuit, and an upper substrate is coupled onto the cathode. The anode may be formed of a transparent conductive material, for example, indium tin oxide (ITO). The cathode may also be formed of ITO.

The organic emission layer may include a hole transport layer (HTL), an emission material layer (EML), and an electron transport layer (ETL). In order to enhance an emission efficiency of the organic emission layer, a hole injection layer (HIL) may be formed between the anode and the HTL, and an electron injection layer (EIL) may be formed between the cathode and the ETL. A structure and function of the OLED are the same as those of an OLED applied to a related art organic light emitting display device, and thus, their detailed descriptions are not provided.

The pixel circuit may be connected to the data line DL and the gate line GL, and may include at least two or more transistors TR1 and TR2 and a storage capacitor Cst, which control the OLED.

The anode of the OLED is connected to a first power source of the pixel circuit, and the cathode is connected to a second power source of the pixel circuit. The OLED outputs light having certain luminance in correspondence with a current supplied from the driving transistor.

When a scan pulse is supplied to the gate line GL, the pixel circuit controls an amount of current supplied to the OLED according to a data voltage (Vdata) supplied to the data line DL.

The gate driver 200 sequentially supplies the scan pulse to the gate lines GL1 to GLg of the panel 100 in response to a gate control signal GCS input from the timing controller 400. Therefore, a plurality of switching transistors formed in each pixel of a corresponding horizontal line receiving the scan pulse may be turned on, thereby emitting light from each pixel.

That is, the gate driver 200 shifts a gate start pulse (GSP), transferred from the timing controller 400, according to a gate shift clock (GSC) to sequentially supply the scan pulse having a gate-on voltage to the gate lines GL1 to GLg. Also, the gate driver 200 supplies a gate-off voltage to the gate lines GL1 to GLg during a period in which the scan pulse is not supplied.

The gate driver 200 is provided independently from the panel 100. The gate driver 200 may be provided in a type which is electrically connected to the panel 100 by various methods. For example, the gate driver 200 may be provided in a gate-in panel (GIP) type. In this case, a gate control signal for controlling the gate driver 200 may include a start signal (VST) and a gate clock (GCLK).

The timing controller 400 outputs the gate control signal GCS for controlling the gate driver 200 and a data control signal DCS for controlling the data driver ICs 300*a* and 300*b*, by using a vertical sync signal, a horizontal sync signal, and a clock which are supplied from an external system (not shown).

The timing controller 400 samples input video data input from the external system, realigns the video data, and supplies the realigned image data (Data) to the data driver ICs 300*a* and 300*b*.

That is, the timing controller 400 realigns the input video data supplied from the external system, and supplies the realigned digital image data (Data). The timing controller 400 generates the gate control signal GCS for controlling the gate driver 200 and the data control signal DCS for controlling the data driver ICs 300*a* and 300*b*, by using the clock, the horizontal sync signal, the vertical sync signal (hereinafter, the clock and the signals are simply referred to as a timing signal), and a data enable signal which are supplied from the external system, and transfers the data control signal DCS and the gate control signal GCS to the gate driver 200 and the data driver 300.

To this end, the timing controller 400 includes: a receiver that receives the various signals such as the input video data supplied from the external system; an image data processor that realigns the input video data among the signals received by the receiver so as to match a structure of the panel 110, and generates the realigned digital image data; a control signal generator that generates the gate control signal GCS and the data control signal DCS for respectively controlling the gate driver 200 and the data driver ICs 300*a* and 300*b* by using the signals received from the receiver; and a transferor that outputs the gate control signal GCS to the gate driver 200 and outputs the data control signal DCS and the image data, generated by the image data processor, to the data driver ICs 300*a* and 300*b*.

Each of the data driver ICs 300*a* and 300*b* converts the image data, input from the timing controller 400, into analog data voltages and respectively supplies the data voltages for one horizontal line to the data lines at every one horizontal period in which the scan pulse is supplied to a corresponding gate line. That is, each of the data driver ICs 300*a* and 300*b* converts the image data into the data voltages by using the gamma voltages supplied from the gamma voltage generator 350*a* or 350*b*, and outputs the data voltages to the data lines DL1 to DLd.

Each of the data driver ICs 300*a* and 300*b* shifts a source start pulse (SSP), input from the timing controller 400, according to a source shift clock (SSC) to generate a sampling signal. Each of the data driver ICs 300*a* and 300*b* latches image data R, G and B according to the sampling signal to convert the image data into data voltages, and respectively supplies the data voltages to the data lines in units of a horizontal line in response to a source output enable signal (SOE).

To this end, as illustrated in FIG. 4, the data driver IC 300*a* may include a shift register 310*a*, a latch 320*a*, a digital-to-analog converter (DAC) 330*a*, an output buffer 340*a*, and a gamma voltage generator 350*a*, and the data driver IC 300*b* may include a shift register 310*b*, a latch 320*b*, a DAC 330*b*, an output buffer 340*b*, and a gamma voltage generator 350*b*.

That is, the data driver IC 300*a* (300*b*) converts the image data into the data voltages by using the gamma voltages supplied from the gamma voltage generator 350*a* (350*b*), and respectively supplies the data voltages to the data lines DL1 to DLd.

Two or more the data driver ICs may be equipped in the display device. Also, three or more the data driver ICs may be equipped in the panel 100 depending on a size and resolution of the panel 100. That is, the display device according to an embodiment of the present invention may include at least two or more the data driver ICs.

Hereinafter, for convenience of description, as illustrated in FIGS. 3 and 4, the display device to which the two data driver ICs 300*a* and 300*b* are applied will be described as an example of the present invention.

A case, in which 5760=(1920×3) pixels are formed on one horizontal line of the panel, will be described as an example of the present invention.

In this case, as illustrated in FIG. 4, the data driver IC 300*a* (300*b*) respectively supplies data voltages to 2880 data lines DL1 to DL2880 (DL2881 to DL5760)

As illustrated in FIG. 4, the data driver IC 300*a* may include the shift register 310*a*, the latch 320*a*, the DAC 330*a*, the output buffer 340*a*, and the gamma voltage generator 350*a*, and the data driver IC 300*b* may include the shift register 310*b*, the latch 320*b*, the DAC 330*b*, the output buffer 340*b*, and the gamma voltage generator 350*b*.

In particular, the gamma voltage generators 350*a* and 350*b* for generating the gamma voltages can be provided respectively in the data driver ICs 300*a* and 300*b* or can be provided externally of the data driver ICs 300*a* and 300*b*, and each of the data driver ICs 300*a* and 300*b* generates the data voltages by using the gamma voltages generated by the other data driver IC.

When the gamma voltage generator 350*a* (350*b*) transfers the generated gamma voltages to the DAC 330*a* (330*b*), the DAC 330*a* (330*b*) selects gamma voltages, respectively corresponding to 2880 pieces of image data transferred from the latch 320, from among the generated gamma voltages, and generates 2880 data voltages respectively corresponding to the 2880 pieces of image data. The generated 2880 data voltages are respectively supplied to the data lines DL1 to DL2880 (DL2881 to DL5760) through the output buffer 340.

Hereinafter, configurations and functions of the data driver ICs 300*a* and 300*b* will be described in detail with reference to FIG. 4.

First, the configurations of the data driver ICs will be briefly described below.

The data driver IC 300*a* (300*b*) may include the shift register 310*a* (310*b*), the latch 320*a* (320*b*), the DAC 330*a* (330*b*), the output buffer 340*a* (340*b*), and the gamma voltage generator 350*a* (350*b*).

The shift register 310*a* (310*b*) outputs the sampling signal by using data control signals (SSC, SSP, etc.) received from the timing controller 400.

The latch 320*a* (320*b*) latches the digital image data that are sequentially received from the timing controller 400, and simultaneously outputs the digital image data to the DAC 330*a* (330*b*) according to the sampling signal.

The DAC 330*a* (330*b*) simultaneously converts the image data, transferred from the latch 320, into data voltages, and outputs the data voltages.

That is, the DAC 330*a* (330*b*) converts the image data R, G and B into the data voltages by using the gamma voltages supplied from the gamma voltage generator 350*a* (350*b*), and outputs the data voltages to the output buffer 340*a* (340*b*).

In particular, each of the DACs 330*a* and 330*b* converts the image data, transferred from the timing controller 400, into the data voltages by using the gamma voltages, generated by the gamma voltage generator included in the data driver IC including the DAC, and the gamma voltages transferred from the outside (for example, another data driver IC).

The output buffer 340*a* (340*b*) outputs the data voltages, transferred from the DAC 330*a* (330*b*), to the data lines DL1 to DLd of the panel 100 according to the source output enable signal (SOE) transferred from the timing controller 400.

The gamma voltage generator 350*a* (350*b*) generates the gamma voltages by using a reference voltage (Vref) supplied from a power supply (not shown), and supplies the gamma voltages to the DAC 330*a* (330*b*).

Second, when three or more data driver ICs are equipped in the panel 100, one of the data driver ICs generates the data voltages by using the gamma voltages generated by a corresponding data driver IC and the gamma voltages generated by at least one other data driver IC, and respectively outputs the generated data voltages to the data lines.

One of the data driver ICs transfers the gamma voltages, generated by a corresponding data driver IC, to at least one other data driver IC.

Third, as illustrated in FIGS. 3 and 4, when two data driver ICs are equipped in the panel 100, one of the two data driver ICs is referred to as a first data driver IC 300*a*, and the other is referred to as a second data driver IC 300*b*.

In this case, a first DAC 330*a* included in the first data driver IC 300*a* may generate the data voltages by using first color gamma voltages and second color gamma voltages, generated by the first gamma voltage generator 350*a* included in the first data driver IC 300*a*, and second color gamma voltages and third color gamma voltages transferred from the second data driver IC 300*b*.

Here, the first color gamma voltages may be red color gamma voltages RG1 to RG8, and the second color gamma voltages may be green color gamma voltages GG1 to GG4.

The second color gamma voltages transferred from the second data driver IC 300*b* may be green color gamma voltages GG5 to GG8, and the third color gamma voltages may be blue color gamma voltages BG1 to BG8.

In this case, the first color gamma voltages and second color gamma voltages generated by the first gamma voltage generator 350*a* are transferred to the second data driver IC 300*b*.

Therefore, the second DAC 330*b* included in the second data driver IC 300*b* generates the data voltages by using the first color gamma voltages and second color gamma voltages, transferred from the first gamma voltage generator 350*a*, and the second color gamma voltages and third color gamma voltages generated by the second gamma voltage generator 350*b*.

That is, the gamma voltages generated by the first data driver IC 300*a* are transferred to the second data driver IC 300*b*, and the gamma voltages generated by the second data driver IC 300*b* are transferred to the first data driver IC 300*a*.

In this case, the first DAC 330*a* may generate the data voltages by using the gamma voltages transferred from the first and second gamma voltage generators 350*a* and 350*b*.

To provide an additional description, the first and second DACs 330*a* and 330*b* may generate the data voltages by using the same gamma voltages.

Also, in another embodiment, when three data driver ICs are equipped in the panel 100, one of the three data driver ICs is referred to as a first data driver IC, another one is referred to as a second data driver IC and the other one is referred to as a third data driver IC.

In this case, a first DAC included in the first data driver IC may generate the data voltages by using first color gamma voltages, generated by the first gamma voltage generator included in the first data driver IC, and second color gamma voltages and third color gamma voltages transferred from the second data driver IC and the third data driver IC. A second DAC included in the second data driver IC may generate the data voltages by using the second color gamma voltages, generated by the second gamma voltage generator included in the second data driver IC, and first color gamma voltages and third color gamma voltages transferred from the first data driver IC and the third data driver IC. A third DAC included in the third data driver IC may generate the data voltages by using third color gamma voltages, generated by the third gamma voltage generator included in the third data driver IC, and first color gamma voltages and second color gamma voltages transferred from the first data driver IC and the second data driver IC.

In this case, the first color gamma voltages generated by the first gamma voltage generator are transferred to the second data driver IC and the third data driver IC. The second gamma voltages generated by the second gamma voltage generator are transferred to the first data driver IC and the third data driver IC. The third gamma voltages generated by the third gamma voltage generator are transferred to the first data driver IC and the second data driver IC.

Therefore, the first DAC included in the first data driver IC generates the data voltages by using the second color gamma voltages and third color gamma voltages, transferred from the second gamma voltage generator and the third gamma voltage generator, and the first color gamma voltages generated by the first gamma voltage generator. The second DAC included in the second data driver IC generates the data voltages by using the first color gamma voltages and third color gamma voltages, transferred from the first gamma voltage generator and the third gamma voltage generator, and the second color gamma voltages generated by the second gamma voltage generator. The third DAC included in the third data driver IC generates the data voltages by using the first color gamma voltages and second color gamma voltages, transferred from the first gamma voltage generator and the second gamma voltage generator, and the third color gamma voltages generated by the third gamma voltage generator.

That is, the gamma voltages generated by the first data driver IC are transferred to the second data driver IC and the third data driver IC, and the gamma voltages generated by the second data driver IC and the third data drier IC are transferred to the first data driver IC. The gamma voltages generated by the second data driver IC are transferred to the first data driver IC and the third data driver IC, and the gamma voltages generated by the first data driver IC and the third data drier IC are transferred to the second data driver IC. The gamma voltages generated by the third data driver IC are transferred to the first data driver IC and the second data driver IC, and the gamma voltages generated by the first data driver IC and the second data drier IC are transferred to the third data driver IC.

In this case, the first DAC may generate the data voltages by using the gamma voltages transferred from the first, second and third gamma voltage generators. The second DAC may generate the data voltages by using the gamma voltages transferred from the first, second and third gamma voltage generators. The third DAC may generate the data voltages by using the gamma voltages transferred from the first, second and third gamma voltage generators.

To provide an additional description, the first, second and third DACs may generate the data voltages by using the same gamma voltages.

Hereinafter, a method of driving the display device according to an embodiment of the present invention will be described in detail.

The method of driving the display device according to an embodiment of the present invention includes: receiving, by one of the data driver ICs equipped in the display device, image data from the timing controller 400 equipped in the display device; generating, by one of the data driver ICs, data voltages respectively corresponding to the image data by using gamma voltages generated by the gamma voltage generator included in a corresponding data driver IC and gamma voltages transferred from the other gamma voltage generators of the other data driver IC's; and respectively outputting, by one of the data driver ICs, the data voltages to the data lines formed in the panel configuring the display device.

Here, the gamma voltages generated by one of the data driver ICs are transferred to at least one other data driver IC.

In particular, in generating the data voltages, when the number of the data driver ICs is at least two, the first data driver IC 300*a* of the data driver ICs may generate the data voltages by using first color gamma voltages and second color gamma voltages, generated by the first data driver IC 300*a*, and second color gamma voltages and third color gamma voltages transferred from the second data driver IC 300*b*.

In this case, the first color gamma voltages and second color gamma voltages generated by the first data driver IC 300*a* are transferred to the second data driver IC 300*b*.

Moreover, in the generating of the data voltages, when the number of the data driver ICs is at least three, the first data driver IC of the data driver ICs may generate the data voltages by using first color gamma voltages, generated by the first data driver IC, second color gamma voltages and third color gamma voltages transferred from the second data driver IC and the third data driver IC. The second data driver IC of the data driver ICs may generate the data voltages by using second color gamma voltages, generated by the second data driver IC, first color gamma voltages and third color gamma voltages transferred from the first data driver IC and the third data driver IC. The third data driver IC of the data driver ICs may generate the data voltages by using third color gamma voltages, generated by the third data driver IC, first color gamma voltages and second color gamma voltages transferred from the first data driver IC and the second data driver IC.

According to the embodiments of the present invention, since the gamma voltages are shared by different data driver ICs, a quality of an image output by the panel can be improved.

Moreover, according to the embodiments of the present invention, block dimming can be prevented from occurring in the panel, and a uniformity of the panel can be enhanced.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A display device comprising:

a panel in which a pixel is formed in each of a plurality of intersection areas between a plurality of data lines and a plurality of gate lines;

two or more data driver integrated circuits (ICs) supplying data voltages to the plurality of data lines;

a gate driver outputting a scan signal to the plurality of gate lines;

a timing controller driving the data driver ICs and the gate driver; and a plurality of gamma voltage generators generating gamma voltages respectively provided to the data driver ICs, wherein each of the data driver ICs generates data voltages by using gamma voltages generated by itself and gamma voltages shared from another data driver IC of the two or more data driver ICs, wherein the two or more data driver ICs include a first data driver IC and a second data driver IC, and the plurality of gamma voltage generators include a first gamma voltage generator and a second gamma voltage generator, and wherein a first digital to analog converter (DAC) included in the first data driver IC generates the data voltages by using gamma voltages of a first color and a first portion of gamma voltages of a second color generated by the first gamma voltage generator included in the first data driver IC, and a second portion of gamma voltages of the second color and gamma voltages of a third color transferred to the first data driver IC from the second data driver IC.

2. The display device of claim 1, wherein the first gamma voltage generator and the second gamma voltage generator are respectively provided in the first data driver IC and the second data driver IC, and each of the data driver ICs generate data voltages by using the gamma voltages generated by another data driver IC.

3. The display device of claim 1, further comprising three or more data driver ICs, wherein one of the data driver ICs generates the data voltages by using the gamma voltages generated by a corresponding data driver IC and the gamma voltages generated by at least one other data driver IC, and respectively outputs the generated data voltages to a corresponding one of the plurality of data lines.

4. The display device of claim 1, wherein the gamma voltages of the first color and the first portion of gamma voltages of the second color generated by the first gamma voltage generator are transferred to the second data driver IC.

5. The display device of claim 1, wherein a second DAC included in the second data driver IC generates the data voltages by using the gamma voltages of the first color and the first portion of gamma voltages of the second color, transferred from the first gamma voltage generator, and the second portion of gamma voltages of the second color and gamma voltages of the third color generated by the second gamma voltage generator.

6. The display device of claim 1, wherein the gamma voltages generated by the first data driver IC are transferred to the second data driver IC, and the gamma voltages generated by the second data driver IC are transferred to the first data driver IC.

* * * * *